US006067768A

United States Patent [19]

Colussi

[11] Patent Number: 6,067,768

[45] Date of Patent: May 30, 2000

[54] FRAME MEMBER FOR A PANEL DOOR

[75] Inventor: Walter Colussi, Maple, Canada

[73] Assignee: DSH Inc., Concord, Canada

[21] Appl. No.: 09/146,235

[22] Filed: Sep. 3, 1998

[51] Int. Cl.[7] ..... E04C 2/38

[52] U.S. Cl. ..... 52/656.2; 52/656.4

[58] Field of Search ..... 52/730.6, 731.7, 52/731.8, 731.9, 734.1, 656.4, 656.5, 656.6, 656.2

[56] References Cited

U.S. PATENT DOCUMENTS

| | | | |
|---|---|---|---|
| 3,058,173 | 10/1962 | Brydolf | 49/490 |
| 3,838,548 | 10/1974 | Tanner | 52/656.4 |
| 4,631,894 | 12/1986 | Jerila | 52/823 |
| 4,884,371 | 12/1989 | Chagnon . | |

*Primary Examiner*—Beth A. Stephan
*Attorney, Agent, or Firm*—Ridout & Maybee

[57] ABSTRACT

A frame member for a panel door such as used in bifold door installation is roll formed from a metal strip to provide a generally E-shaped cross-section having a side member with front, middle and rear limbs extending generally perpendicularly from the side member; the strip defining successively from edge to edge the rear limb, the side member, an outer layer of the front limb, a retroverted inner layer of the front limb, an inner layer of the side member extending between the front and middle limbs, and the center limb, an edge of the strip being retroverted to provide a double thickness through a distal portion of the middle limb, an inner portion of the middle limb being inclined towards the front limb as it extends from the side member towards a panel contact zone on that side of the middle limb facing the front member, and the distal portion being inclined away from the front member as it extends beyond the contact zone, the inner and distal ends of the middle limb being spaced from the front limb by a distance at least equal to the greatest thickness of panel to which the frame member is to be applied, the contact zone being spaced from the front limb by a distance less than the least thickness of panel to which the frame member is to be applied, and the distance of the contact zone from the side member being less than the extent of the front limb.

4 Claims, 1 Drawing Sheet

FRAME MEMBER FOR A PANEL DOOR

This invention relates to roll-formed frame members applied to panels to form a panel type door, particularly although not exclusively, for bifold doors.

Such doors and certain problems associated with them are discussed in U.S. Pat. No. 4,631,894 (Jerila) which describes roll-formed frame members intended to improve on prior art frame members such as those for example described and illustrated with reference to FIG. 6 of U.S. Pat. No. 3,058,173 (Brydolf). Jerila is concerned to provide frame members in which the width of the frame portion overlapping the front surface of the panel is reduced. Further prior art roll-formed frame members of the same general E-section are described and illustrated in U.S. Pat. Nos. 3,058,173 (Tanner) and 4,884,371 (Gagnon).

Jerila is concerned with providing a roll-formed stile member which avoids the necessity of providing a broad overlap over the front surface of the panel without prejudicing the stiffness of the stile. With this in view, he extends the middle limb of the E-section stile and folds it back, with a terminal portion of the folded back portion inclined away from the limb towards the front and side members of the E-section to provide a flexible deflection arm. Since the end of this deflection arm is not far from the side member, the bending moment applied to the middle limb arm by deflection of the deflection arm is comparatively small. Disadvantages of the arrangement are that the spacing between the front and middle limbs must be sufficient to accommodate not only the thickest panel to be used, but also the deflection arm itself, and the point of contact between the deflection arm and the panel must be fairly close in to the side member if the bending moment on the arm is to be kept small. At the same time, if the deflection arm is long enough that most of the deflection is restricted to it, the gripping force applied to the panel is correspondingly reduced. For a given gripping force, on the panel, the twisting force is not reduced. The stiffening effect of the folded back portion of the middle limb is limited since it is spaced from the side member by more than the length of the deflection arm, and is not in contact with the panel.

Having analyzed the problem, I find that a comparable reduction in the width of the front limb can be achieved without requiring extension of the centre limb beyond the front limb, and that a firmer grip can be achieved on the panel, without increasing the risk of distortion of the stile, by use of a quite different configuration of the centre arm, which permits, for a given panel thickness, the spacing between the front and centre arms to be reduced, thus reducing the effect of bending moments transmitted from the centre arm to the side wall.

According to the invention, there is provided a frame member for a panel door such as used in bifold door installation is roll formed from a metal strip to provide a generally E-shaped cross-section having a side member with front, middle and rear limbs extending generally perpendicularly from the side member; the strip defining successively from edge to edge the rear limb, the side member, an outer layer of the front limb, a retroverted inner layer of the front limb, an inner layer of the side member extending between the front and middle limbs, and the centre limb, an edge of the strip being retroverted to provide a double thickness through a distal portion of the middle limb, an inner portion of the middle limb being inclined towards the front limb as it extends from the side member towards a panel contact zone on that side of the middle limb facing the front member, and the distal portion being inclined away from the front member as it extends beyond the contact zone, the inner and distal ends of the middle limb being spaced from the front limb by a distance at least equal to the greatest thickness of panel to which the frame member is to be applied, the contact zone being spaced from the front limb by a distance less than the least thickness of panel to which the frame member is to be applied, and the distance of the contact zone from the side member being less than the extent of the front limb.

Preferably, the extent of the middle limb is less than that of the front limb, which in turn is less than that of the rear limb.

The specified configuration of the middle limb permits its rear portion to deflect to allow insertion and then to grip the panel, while the retroverted distal portion stiffens the frame member as a whole; since this stiffened portion directly contacts the panel at the contact zone, and is relatively close to the stile member, its stiffening effect is enhanced. The spacing between the front and middle limbs can be kept as small as possible, thus helping to resist distortion, while the front member can be made just as narrow as is possible using the style configuration of U.S. Pat. No. 4,631,8941. Because the middle limb can be made so much shorter, and it can be located closer to the front limb, deflection of the centre limb towards the rear limb during panel insertion is no longer a problem.

SHORT DESCRIPTION OF THE DRAWINGS

FIG. 1 is a cross-section through a presently preferred embodiment of frame member in accordance with the invention, showing it positioned adjacent an edge of a panel member prior to pressing it on to the latter.

DESCRIPTION OF THE PREFERRED EMBODIMENT

Figure 1:
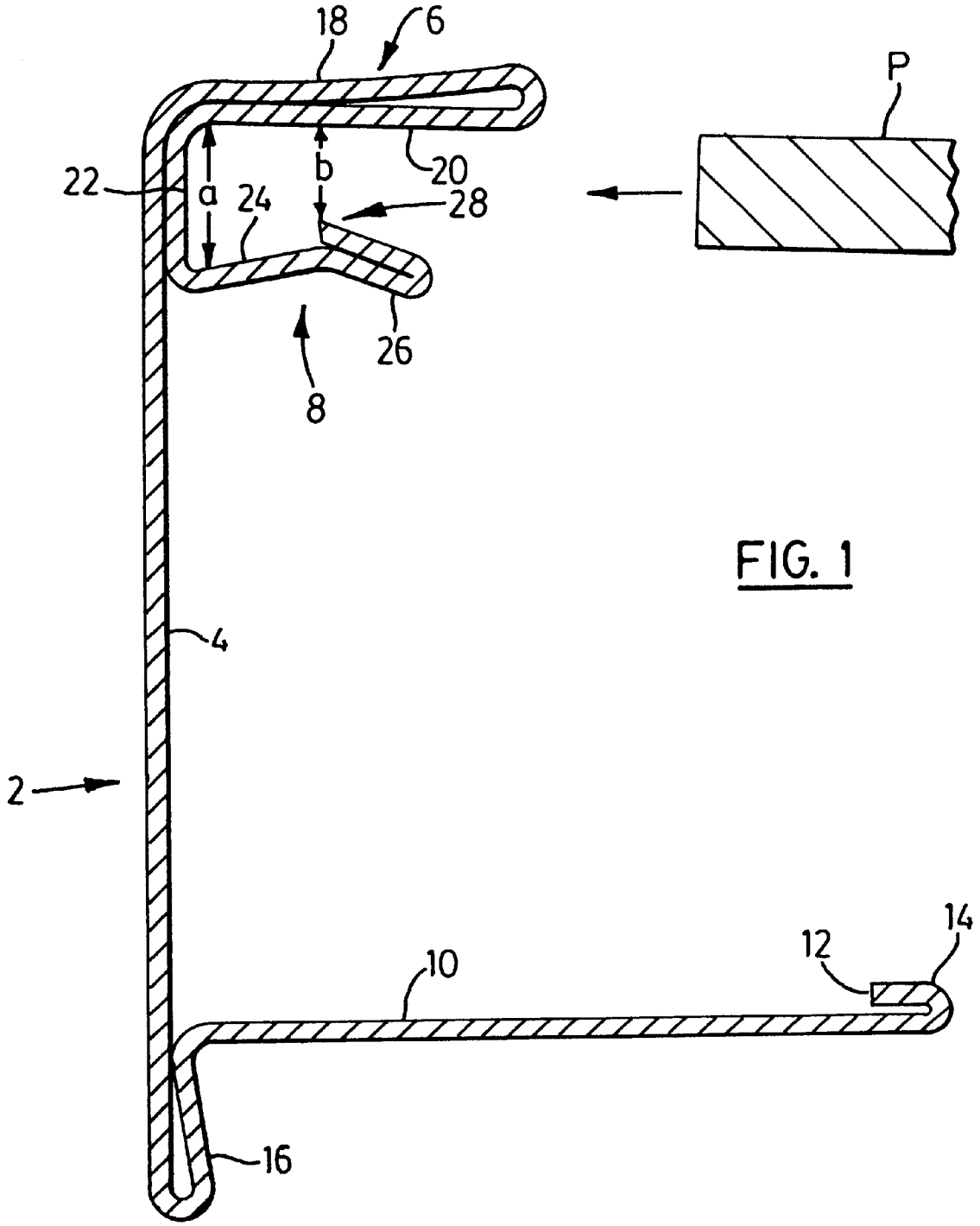

FIG. 1 shows the cross-section of a frame member 2 roll-formed from a strip of metal, typically steel. The frame member is generally of E-shape, with a side member or spine 4, and front, middle and rear limbs 6, 8 and 10 projecting from the spine. Starting from the edge 12 of the strip, it is formed into a retroverted fold 14 forming a distal end of the limb 10. At the inner end of the limb 10 the strip is folded rearwardly into a flange 16 which forms a continuation of side member 4 which extends from the flange to the inner end of front limb 6. The designations "front" and "rear" relate to a final panel door assembly, the front side being the finished, normally visible side. After forming an outer layer 18 of the front limb 6, the strip is retroverted back to form an inner layer 20 of the front limb and an inner layer 22 of a front portion of the side member 4 before turning away from the side member 4 to form the middle limb 8. A rear portion 24 of the middle limb is inclined towards the front limb as it extends away from the side member, while a distal portion 26 is inclined away from the front limb beyond a zone 28 intended to contact the panel P when it is inserted between the front and intermediate member. An opposite edge portion of the strip is retroverted as shown so that the distal portion 26 of the middle limb is of double thickness. The spacing between the front and middle limbs adjacent the zone 28 is less than the anticipated minimum thickness of the panel P, while the spacing between the same members at their inner ends is more than the anticipated maximum thickness of the panel P.

On assembly, the edge of the panel P is pressed between the front and middle limbs, acting on the contact zone 28 to deflect the middle limb so that it may reach and abut the layer 22. The deflection of the limb 8 generates a reaction force clamping the panel between the contact zone 28 and the limb 6. The bending moment applied to the side member 4 will be proportional to the gripping force applied to the panel for a given distance between the side member and the contact zone, but the reduced distance between the middle and front limbs as compared with the Jerila stile will tend to reduce the effect of this force. The reinforcing effect of the distal portion of the middle limb will be enhanced since it will lie directly against the panel at the contact zone. The extended rear limb and rear flange provide stiffening to resist the twisting forces applied through the middle limb when a panel is inserted.

The space between the middle and rear limbs is utilized to accommodate corner connections which connect the frame members so as to complete the panel door and also provide means for supporting the door and connecting adjacent panel doors in bifold arrangements. These corner connectors form no part of the invention and will not be described; their accommodation may however influence the configuration of the frame member and it will be understood the exact configuration shown is exemplary only and may be varied within the scope of the appended claims.

What is claimed is:

1. A frame member for a door panel comprising a metal strip roll-formed to provide a generally E-shaped cross-section having a side member with front, middle and rear limbs extending generally perpendicularly from the side member; the strip defining successively from edge to edge the rear limb, the side member, an outer layer of the front limb, a retroverted inner layer of the front limb, an inner layer of the side member extending between the front and middle limbs, and the middle limb, an edge of the strip being retroverted to provide a double thickness through a distal portion of the middle limb, an inner portion of the middle limb being inclined towards the front limb as it extends from the side member towards a panel contact zone on the side of the middle limb facing the front member, and the distal portion being inclined away from the front member as it extends beyond the contact zone, the inner and distal ends of the middle limb being spaced from the front limb by a distance at least equal to the greatest thickness of a panel to which the frame member is to be applied, the contact zone being spaced from the front limb by a distance less than the least thickness of the panel to which the frame member is to be applied, and the distance of the contact zone from the side member being less than the extent of the front limb.

2. A frame member according to claim 1, wherein the extent of the middle limb is less than the extent of the front limb, and the extent of the front limb is less than the extent of the rear limb.

3. A frame member according to claim 2, wherein the strip between the rear and side member has a fold defining a double thickness flange forming a rearward extension of the side member.

4. A frame member according to claim 2, wherein the strip is retroverted at a distal end of the rear member.

* * * * *